United States Patent [19]

Slade

[11] Patent Number: 4,553,002

[45] Date of Patent: Nov. 12, 1985

[54] AXIAL MAGNETIC FIELD VACUUM-TYPE CIRCUIT INTERRUPTER

[75] Inventor: Paul G. Slade, Penn Hills, Pa.

[73] Assignee: Westinghouse Electric Corp., Pittsburgh, Pa.

[21] Appl. No.: 557,793

[22] Filed: Dec. 5, 1983

[51] Int. Cl.[4] ..... H01H 33/66

[52] U.S. Cl. ..... 200/144 B; 313/153

[58] Field of Search ..... 200/144 B; 313/217

[56] References Cited

U.S. PATENT DOCUMENTS

| | | | |
|---|---|---|---|
| 2,949,520 | 8/1960 | Schneider | 200/144 B |
| 3,089,936 | 5/1963 | Smith, Jr. | 200/144 B |
| 3,471,733 | 10/1969 | Rich | 313/217 |
| 3,705,144 | 12/1972 | Genequand | 200/144 B |
| 3,764,764 | 10/1973 | Takasuna et al. | 200/144 B |
| 3,809,836 | 5/1974 | Crouch | 200/144 B |
| 3,845,262 | 10/1974 | Hundstad | 200/144 B |
| 3,858,076 | 12/1974 | Mitchell | 313/217 |
| 3,935,406 | 1/1976 | Murano et al. | 200/144 B |
| 4,117,288 | 9/1978 | Gorman et al. | 200/144 B |
| 4,453,054 | 6/1984 | Peche et al. | 200/144 B |

FOREIGN PATENT DOCUMENTS

| | | | |
|---|---|---|---|
| 2644234 | 4/1978 | Fed. Rep. of Germany | 200/144 B |

*Primary Examiner*—Robert S. Macon

*Attorney, Agent, or Firm*—John Victor Pezdek

[57] ABSTRACT

An axial magnetic field vacuum-type circuit interrupter. Provided in an evacuated housing is a pair of opposed contacts at least one of which is movable with respect to the other and is movable between a closed position in engagement with the other contact to an open position spaced apart from the other contact to form an arcing gap therebetween during circuit interruption. Each contact includes a disc-shaped backing plate having at least two radially spiraling slots therethrough and a contact and arcing ring secured to and positioned about the face of the backing plate. The backing plates are substantially parallel to one another with the direction of the spiraling slots therethrough being reversed with respect to those of the opposing contact. Because of the reversed direction of spiraling in the opposed faces of the backing plates, an axial magnetic field is created by the flow of current through the contact structure which causes the arc to remain diffuse during the circuit interruption. In a further embodiment, the contact and arcing ring is provided with a plurality of axially skewed closed end radially slots extending therethrough. The slanted slots provide a transverse component to the magnetic field which drives any columnar arc formed around the rim of the contact and arcing rings.

6 Claims, 3 Drawing Figures

AXIAL MAGNETIC FIELD VACUUM-TYPE CIRCUIT INTERRUPTER

BACKGROUND OF THE INVENTION

The present invention relates to a vacuum-type circuit interrupter and more particularly to a contact structure used in such vacuum interrupters.

The capabilities and advantages of the vacuum interrupter for use in medium voltage switching circuits have now been widely recognized. Vacuum interrupters have been applied in distribution reclosures, metal-clad switch-gear, tap changers and contactors. Most of the present applications have been confined to voltages of less than or equal to 38 kV although investigations at higher voltages have been reported.

In a typical vacuum interrupter high-purity, gas-free contacts are housed within an evacuated envelope in which the ambient gas pressure is approximately $10^{-6}$ torr. Usually one contact is stationary while the other contact is made movable by means of a metallic bellows. When the interrupter is closed, the contacts butt together. Arcing is established within the interrupter by withdrawing the bellows contact from the stationary contact. The arc burns and the metal vapor evaporates from local hot spots on the surfaces of the contacts. The metal vapor continually leaves the intercontact region and condenses on the contact surfaces as well as a surrounding metal shield. The latter is usually isolated from both contacts, but can be constructed to be isolated from only one and serves to protect the insulating envelope from vapor deposition. At current zero, contact vapor production ceases and the original vacuum condition is rapidly approached. The dielectric strength of the interrupter also increases and the circuit is interrupted. With the contacts in the open position the circuit voltage is isolated internally by the intercontact gap and externally by the insulating envelope.

The vacuum interrupter contacts have to satisfy a number of potentially conflicting design criteria. In the closed position they must carry the steady-state current without excessive overheating. When open, the contacts must provide sufficient metal vapor to permit the arc to carry the circuit current smoothly to the current zero. At current zero, however, there must be insufficient metal vapor for the arc to re-ignite when the restored voltage appears across the contacts. The opening contacts must be capable of interrupting a wide range of currents from very low currents involved when switching cables and capacitor banks, to the normal continuous duty current, to overload currents, and finally to high short circuit currents. The contacts must not weld and must have the strength to survive many thousands of operations. As the range of the vacuum interrupter has increased to interrupt higher and higher short circuit currents, the design of the contact shape has become important.

Three different modes of arcing have been observed with vacuum-type interrupters. The first, the diffuse vacuum arc, is characterized by a multitude of small cathode spots from which both electrons and ions are emitted, a diffuse interelectrode plasma, and current collection across the entire surface of the anode. This arc mode typically occurs at currents less than approximately 7 kA. The second, the anode spot, can form as the current is increased or the contact gap is widened. Here, the anode had a grossly evaporating hot region although multiple cathode spots can still exist. At even higher currents, an arc column, the third form, can bridge the contact gap. During actual interruption of the circuit, a combination of these three modes of arcing can occur.

As the contacts part during circuit interruption, they are separated by a molten metal bridge that forms at the last point of contact. Once the bridge has ruptured, there is a brief period during which the arc is now confined to the vicinity of the bridge. Now depending upon the current level, the vacuum arc can progress to one of the three possible forms. For currents of less than about 7 kA a diffuse arc will develop. For currents between about 7 kA to about 15 kA the arc can form a transitory diffuse column which will either become a diffuse arc or a more constricted column. At currents higher than 15 kA, the confined arc develops into a constricted column immediately. At low currents the diffuse arc can stay diffuse all the way to current zero. Depending upon the current level and contact spacing, however, the diffuse arc can form an anode spot and a columnar arc before going diffuse again close to current zero. The constricted column will stay constricted until just before the current zero. At the highest current, the electrode region of this constrictive column exhibits intense activity with jets of material being ejected from the contact faces. In spite of this severe contact activity, even this arc mode can return to the diffuse mode just before current zero.

Electric contacts that have a diffuse vacuum arc burning between them many milliseconds before current zero will have excellent dielectric recovery properties after current zero. The reason for this results from the properties of the cathode spots. First, the ions are ejected from the spot at very high velocity ($\sim 10^6$ cm/sec) and so will clear the contact region in a few milliseconds after current zero. Secondly, the spots themselves are extremely small ($\sim 10$ micrometers) thus, they will cool very rapidly after current zero (5 microseconds or less) and will not liberate metal vapor into the intercontact gap. During the arcing period small particles of contact material are ejected from the cathode spots tangentially to the contact face, and thus move away from the intercontact gap in the shortest possible time. In contrast, with an anode spot or a columnar arc, the contact faces can be grossly heated and there can be liberal evaporation of metal vapor after current zero. This metal vapor prevents rapid dielectric recovery of the contact gap by providing a possible breakdown path for the restored voltage. It is important, therefore, to minimize arc-heating of the vacuum contacts during the current half cycle and to maximize the time during the half cycle for which the arc remains diffuse. In order to do this, many electric contact designs have been proposed. These designs may be split into three major groupings. These are: (1) large area contacts; (2) contacts that cause the roots of the columnar arc to move rapidly over their surfaces; and (3) contacts that force the high current vacuum arc to remain diffuse.

The earliest vacuum interrupters used simple butt contact structures and for low current diffuse arc switching, these contacts work very well. At higher currents the intense electrode activity caused severe erosion of the contacts resulting in their failure to interrupt the current. It was found that an anode spot would form from a diffuse arc if at a given contact gap, the anode area were too small. In response to this finding, the large area contact was developed. Examples of this type of contact can be found in U.S. Pat. No. 3,889,081, issued June 10, 1975 entitled "Vacuum Interrupter Contacts Having Energy Dissipation Surfaces"; U.S. Pat. No. 3,667,871, issued June 6, 1972 entitled "Contact Structures for Vacuum-Type Circuit Interrupters Having Outwardly-Extending Spokes"; U.S. Pat. No. 3,471,733, issued Oct. 7, 1969 entitled "High Current Vacuum Gap Devices"; U.S. Pat. No. 3,471,736, issued Oct. 7, 1969 entitled "Vacuum Gap Devices with Helicodial Electrode Structure"; U.S. Pat. No. 3,858,076, issued Dec. 31, 1974 entitled "Vacuum-Type Circuit Interrupter with Interleaving Spiral Electrodes" and U.S. Pat. No. 3,705,144, issued Dec. 5, 1972 entitled "Vacuum Interrupter or Switch for Electric Power Networks". Unfortunately, this type of contact structure has proved to be impractical because the designers did not take into account the initial confinement of the vacuum arc after rupture of the molten metal bridge. When the arc current was high enough, this confined arc remained constricted and caused gross erosion and overheating of the contacts. As a result of the problems encountered with large area contacts, the design of contacts which enhanced arc motion was pursued.

With a diffuse vacuum arc, the cathode spots move away from each other in a manner termed retrograde motion. At high currents when the vacuum arc is confined, it has been shown that the arc moves in an Amperian manner when interacting with a transverse magnetic field. Here, the arc is forced to move across the contact face through the interaction between the current flowing in the arc and a transverse magnetic field resulting from the current flowing in the contact. The earliest design of this type of contact, the spiral contact, can be found in U.S. Pat. No. 2,949,520 issued Aug. 16, 1960 entitled "Contact Structure for an Electric Circuit Interrupter." There, the opposed contact faces had a plurality of matching spiral arms. During arc constriction, the self-magnetic field generated by the current flowing in the matching spiral arms of each contact interacted with the current flowing in the arc to force the arc to move between and along the spirals. When the arc roots reached the ends of the spiral arms, they were forced to jump the gap to the next spiral arm by the arc column continuing to move in the transverse direction. Extremely rapid arc motion could be achieved even though the transverse magnetic field acting on the arc is much less than the magnetic field between the spiral arms behind the arc. Further examples of this type of contact structure can be found in U.S. Pat. No. 3,845,262, issued Oct. 29, 1974 entitled "Contract Structures for Vacuum-Type Circuit Interrupters Having Cantilevered-Supported Annular-Shaped Outer Arc-Running Contact Surfaces" and U.S. Pat. No. 3,809,836, issued May 7, 1974 entitled "Vacuum-Type Electric Circuit Interrupter". One disadvantage with this style of contact is the arc may pause momentarily at the spiral ends leading to high contact wear at this portion of the contact face. An arcing ring can be affixed to the contact face to ensure that the arc roots do not pause momentarily at the spiral ends. However, here the disadvantage is that the current can flow into the spiral arm from both directions and this will result in a considerably lower magnetic field and, hence, a lower driving force.

Another contact design in this group is the contrate or cup contact, as exemplified by U.S. Pat. No. 3,089,936, issued May 14, 1963 entitled "Contact Structure for an Electric Circuit Interrupter" and U.S. Pat. No. 4,149,050, issued Apr. 10, 1979 and entitled "Cup-Shaped Contacts for Vacuum Interrupter Having Continuous Annular Contact Surface". In both instances, slanted slots are cut into the cup side to provide a transverse component to the magnetic field which drives the arc around the cup's rim. It has been found that the arc runs best in this design if the slots do not extend all the way to the rim or else the slots are pushed closed at the top. This class of contact, spiral and cup, is at present the preferred contact structure used by the majority of vacuum interrupter manufacturers.

The third group of contacts maintains a diffuse arc at high currents by applying an axial magnetic field as compared to the transverse magnetic field produced by the spiral contacts. By applying a sufficiently high axial magnetic field following the rupture of the molten metal bridge during current interruption, the confined arc forms and slowly expands into a diffuse arc which burns until current zero. Once the arc has gone diffuse, the axial magnetic field allows the arc to remain diffuse. The electrons are confined by the axial magnetic field lines in the intercontact gap and because of the associated creation of radial electric fields the ions are also confined to this region. During this high current arcing, the diffuse arc distributes the arc energy over the whole contact surface and thus prevents gross erosion of the contacts. With this design of contact, the axial magnetic field in the vacuum interrupter should be close to its maximum value when the arc current is greatest. One method of applying an axial magnetic field is to wrap a coil which carries the circuit current around the outside of the vacuum interrupter. This arrangement has been used successfully for the repetitive switching of high current DC circuits. Although there have been some applications of external coils to AC switches, the method presents a number of disadvantages and limitations including:

(A) the resulting interrupter tends to be bulky and in three-phase circuits will effect the pole-to-pole spacing;

(B) the coils must be insulated;

(C) when the fault current occurs, it takes time for the magnetic field to penetrate the intercontact gap; and (D) when the magnetic field penetrates the intercontact gap, eddy current effects in the vacuum interrupter structure can cause the magnetic field to be out-of-phase with the current.

In order to overcome these disadvantages a number of axial magnetic field electric contact designs have been developed. An example may be found in U.S. Pat. No. 3,935,406, issued Jan. 27, 1976 entitled "Vacuum Interrupter." There, a coil is placed behind the contact face with slots in the face of the contact being provided to reduce eddy currents. This type of contact structure has been used to interrupt very high currents, 200 kA at 12 kV circuits up to 63 kA and 72 kV circuits. The advantage of this type of contract structure is that it maximizes the axial magnetic field at the current peak and hence enhances the probability that a diffuse vacuum arc is obtained. However, the contact structure used to achieve this advantage is mechanically complex. Thus, it would be advantageous to have a simplified contact structure that maximizes the axial magnetic field at the current peak.

SUMMARY OF THE INVENTION

The present invention is embodied in a vacuum-type circuit interrupter comprising an evacuated housing and a pair of opposed contacts at least one of which is movable with respect to the other positioned within the housing. In the closed position, the contacts are in engagement, in the open position the contacts are spaced apart forming an arcing or intercontact gap therebetween wherein an arc can form during circuit interruption. Each contact includes a disc-shaped backing having at least two similarly directed, radially spiraling slots therethrough. The backing plates are substantially parallel to one another with the direction of the spiraling slots therethrough being reversed with respect to those of the opposing contact. A contact face and arcing ring is provided on top the opposed face of each of the backing plates. In an alternate embodiment a plurality of axially skewed closed and radial slots can be provided in the arcing ring.

One object of the invention is to provide a simplified contact structure employing an axial magnetic field.

Another object of the invention is to provide a contact structure where the axial magnetic field is maximized during the maximum current flow. The use of reversed spiral slots in the opposed backing plates in combination with contact/arcing rings is a feature of the invention that is used to provide these objects.

BRIEF DESCRIPTION OF THE DRAWINGS

For a better understanding of the invention, reference may be made to the embodiments exemplary of the invention shown in the accompanying drawings wherein.

DESCRIPTION OF THE PREFERRED EMBODIMENTS

Figure 1:
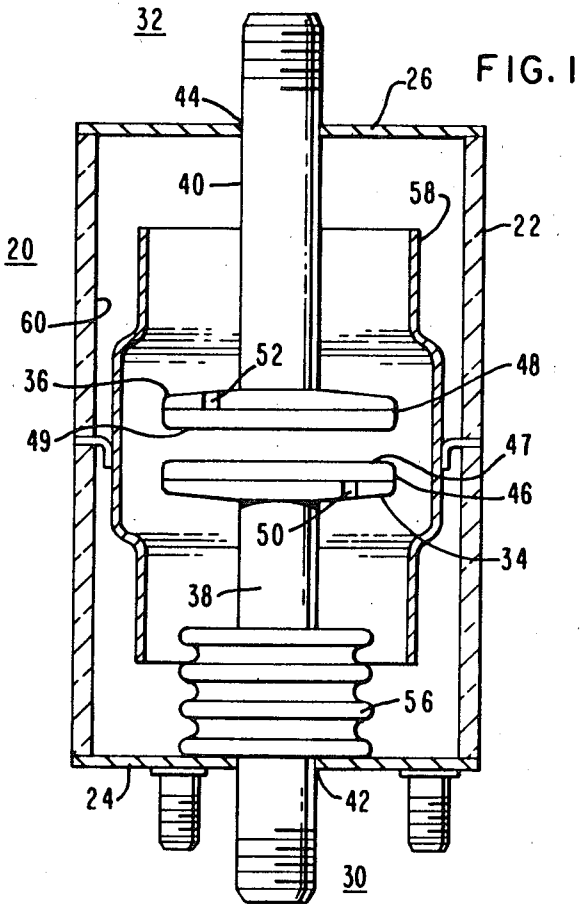
FIG. 1 is a sectional view of a vacuum-type circuit interrupter embodying the present invention.

Referring to FIG. 1 the vacuum interrupter 10 comprises an evacuated housing in which a pair of contacts is positioned. The housing generally indicated at 20 consists of a hollow cylindrical insulating envelope 22, the ends of which are closed by the metallic end caps 24 and 26. The contact pair consists of a movable contact 30 and a stationary contact 32. The movable and stationary contacts 30 and 32 are constructed of disc-shaped contact backing plates 34 and 36, respectively, secured to one end of the conductive stems 38 and 40, respectively. The other ends of the stems 38 and 40 extend through openings 42 and 44, respectively, in the end caps 24 and 26. Stem 40 of the stationary contact 32 is usually welded to the end cap 26 to ensure a gas-tight seal. The contact and arcing rings 46 and 48 are secured to the opposed faces of the spiral backing plates 34 and 36, respectively. The rims 47 and 49 of the contact and arcing rings 46 and 48, respectively provide the engagement surfaces when the interrupter is closed. At least two radially spiraling slots indicated at 50 and 52 are also provided in and extend through each of the backing plates 34 and 36, respectively. A bellows 56 is used to allow for the axial motion of the movable contact 30 while maintaining the integrity of the evacuated housing 20. A hollow cylindrical metal shield 58 is provided intermediate the contacts and the inner wall 60 of the insulating envelope 22. The metal shield 58 is electrically isolated from both contacts and serves to protect the insulating envelope 22 from deposition of metal vapors that occur during circuit interruption. It is also possible, for certain limited applications, to have the metal shield 58 electrically attached to one end of the interrupter.

Figure 2:
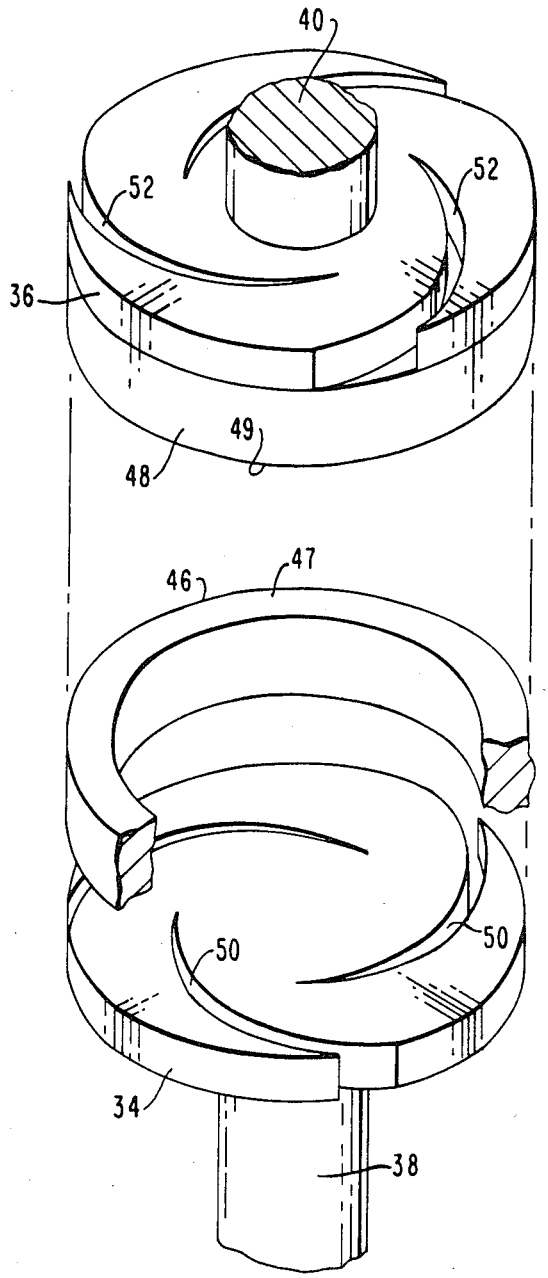
FIG. 2 is an exploded isometric view of the contact structure employed in FIG. 1.

As can be more clearly seen in FIG. 2, at least two radially extending spiraling slots indicated at 50 and 52 are cut through the backing discs 34 and 36, respectively, of each of the opposed contacts 30 and 32. In contrast with the previously discussed slotted contact structures, the direction of spiraling of the slots in one contact face is reversed with respect to those in the opposing contact face. All of the slots in each contact face spiral in a similar direction. The current flows through the contact stem and then along the spiral arms in the backing disc into the arcing ring of one contact with the current path being reversed through the opposing contact. Because the spirals and the contact faces oppose each other, an axial magnetic field component is produced across the intercontact cap formed during opening. Because the axial magnetic field is created by the current flow through the contact structure, the maximum magnetic field is present during maximum current flow. The exact shape and number of spiral slots required will vary depending upon axial magnetic field configuration required for the particular application.

The design of the spirals in the backing plates embodied by the present invention utilizes the principal of the flow of current through a "coil like" structure to produce a magnetic field. The current flows up one of the contact stems and into one of the backing spiral plates. It then is forced to flow along the spiral arms, because contact is made on the raised rim of the arcing ring. It is then conducted into the other contact face on the opposing contact and arcing ring and flows away from the other contact through the backing spiral arms of the second contact structure. By reversing the direction of the spirals of one contact structure with respect to the other, the current flow acts as if it were flowing in a loop to create an axial magnetic field. When the contacts part of the arc forms on the contact rim and the axial magnetic field is maintained.

Figure 3:
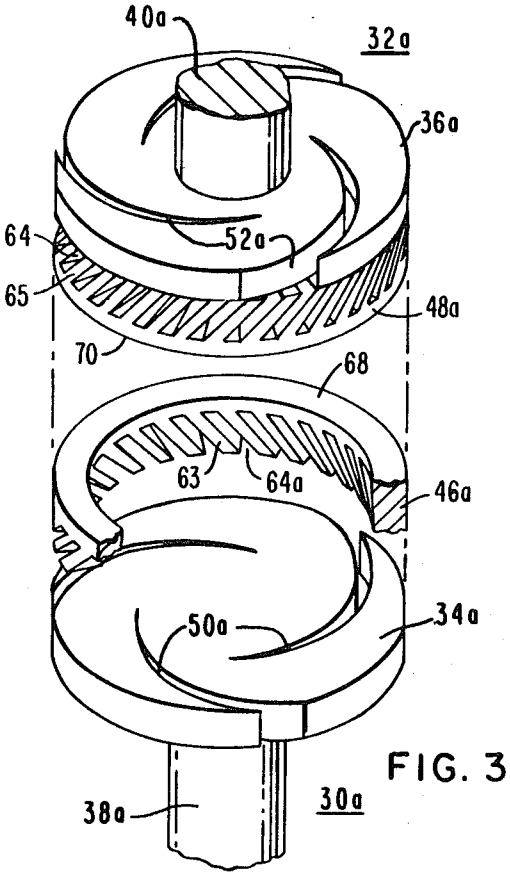
FIG. 3 is an exploded isometric view of an alternate embodiment for the contact structure used in the vacuum-type circuit interrupter of FIG. 1.

An alternate embodiment for the contacts is shown in FIG. 3. There the contacts 30*a* and 32*a* include the contact faces 34*a* and 36*a*, respectively, having the spiral slots 50*a* and 52*a*, respectively, therethrough and mounting on the contact stems 38*a* and 40*a*, respectively. A plurality of axially skewed closed end radial slots 62 and 64 can be provided through the walls 63 and 65, respectively, of each of the arcing rings 46*a* and 48*a*, respectively. The current flow through the resulting axially skewed arms in the arcing rings 46*a* and 48*a* provide a transverse component to the magnetic field that drives any arc column that forms around the rims 68 and 70 of the arcing rings 46*a* and 48*a*, respectively.

The contact can be constructed by stamping the spirally slotted face from copper or copper alloy and then brazing the contact/arcing ring to it. The arcing ring can be fabricated from a suitable arc-resistant materials including chromium copper, silver-tungsten, copper tungsten, silver tungsten carbide, or copper bismuth.

Other embodiments of the invention will be apparent to those skilled in the art from a consideration of this specification or practice of the invention disclosed herein. It is intended that the specification be considered as exemplary only with the true scope and spirit of the invention being indicated by the following claims.

I claim:

1. A vacuum-type circuit interrupter, comprising:

an evacuated housing;

a pair of opposed contacts at least one of which is movable with respect to the other and is movable between a closed position in engagement with the other contact to an open position spaced apart from the other contact to form an arcing gap therebetween wherein an arc can form during circuit interruption, the contact pair positioned within the housing, each contact including a disc-shaped backing plate having at least two radially spiraling slots therethrough with the slots having a similar direction of spiraling, the backing plates being substantially parallel to one another with direction of the spiraling slots therethrough being reversed with respect to those of opposing contact; and a contact and arcing ring secured to the opposed face of each of the spiral backing plates for ensuring current flow through the spiral arms of the disc shaped backing.

2. The vacuum-type circuit interrupter of claim 1 wherein the walls of each contact and arcing ring is provided with a plurality of axially skewed closed-end radial slots extending therethrough.

3. The vacuum-type circuit interrupter of claim 1 wherein the spiral backings are made of copper and the contact and arcing rings are made from a material selected from the group consisting of a chromium-copper mixture, silver-tungsten, copper-tungsten, silver-tungsten-carbide or copper bismuth.

4. Opposed contacts for use in vacuum-type circuit interrupter wherein at least one of the contacts is movable with respect to the other and is movable between a closed position in engagement with the other contact to an open position spaced apart from the other contact to form an arcing gap therebetween wherein an arc can form during circuit interruption, each contact comprising:

a disc-shaped backing plate having at least two radially spiraling slots therethrough with the slots having a similar direction of spiraling, the back plates being substantially parallel to one another with direction of the spiraling slots therethrough being reversed with respect to those of opposing contact; and a contact and arcing ring secured to the opposed face of each of the spiral backing plates for ensuring current flow through the spiral arms of the disc shaped backing.

5. The opposed contacts of claim 4 wherein each arcing ring is provided with a plurality of axially skewed closed-end radial slots extending therethrough .

6. The opposed contacts of claim 4 wherein the spiral backings are made of copper and the contact and arcing rings are made from a material selected from the group consisting of a chromium-copper mixture, silver-tungsten, copper-tungsten, silver-tungsten-carbide or copper bismuth.

* * * * *